US009470037B1

(12) United States Patent
Haynes

(10) Patent No.: US 9,470,037 B1
(45) Date of Patent: Oct. 18, 2016

(54) THERMAL BREAK SYSTEM AND METHOD FOR DOORS AND WINDOWS

(71) Applicant: Robin Haynes, Durham, NC (US)

(72) Inventor: Robin Haynes, Durham, NC (US)

(73) Assignee: Donatello Doors Inc., Las Vegas, NV (US)

( * ) Notice: Subject to any disclaimer, the term of this patent is extended or adjusted under 35 U.S.C. 154(b) by 0 days.

(21) Appl. No.: 14/833,138

(22) Filed: Aug. 23, 2015

Related U.S. Application Data

(60) Provisional application No. 62/141,615, filed on Apr. 1, 2015.

(51) Int. Cl.

| | |
|---|---|
| ***E06B 1/32*** | (2006.01) |
| ***E06B 1/12*** | (2006.01) |
| ***E04C 3/29*** | (2006.01) |
| ***E06B 3/263*** | (2006.01) |
| ***E06B 1/18*** | (2006.01) |
| *E04C 3/07* | (2006.01) |

(52) U.S. Cl.
CPC ..... *E06B 1/325* (2013.01); *E04C 3/29* (2013.01); *E06B 1/12* (2013.01); *E06B 1/18* (2013.01); *E06B 3/26301* (2013.01); *E04C 3/07* (2013.01)

(58) Field of Classification Search
CPC ..... E06B 1/18; E06B 1/12; E06B 1/325; E06B 2003/7076; E06B 3/26301; E06B 3/9616; E04B 1/08; E04B 2/7412; E04C 2003/0413; E04C 2003/043; E04C 2003/0465; E04C 3/07; E04C 3/29
See application file for complete search history.

(56) References Cited

U.S. PATENT DOCUMENTS

| | | | | |
|---|---|---|---|---|
| 2,447,272 A * | 8/1948 | Parkes | E04B 1/6104 | 52/578 |
| 2,742,117 A * | 4/1956 | Tolman | E06B 1/20 | 49/399 |
| 3,352,074 A * | 11/1967 | Schwartzberg | E06B 1/6061 | 49/504 |
| 3,436,885 A * | 4/1969 | Rothermel | E04B 2/62 | 52/207 |
| 3,571,995 A * | 3/1971 | Kasprzak | E06B 1/20 | 49/505 |
| 3,861,099 A * | 1/1975 | Faudree | E06B 1/18 | 52/211 |
| 3,908,313 A * | 9/1975 | Bierlich | E06B 3/26301 | 49/501 |
| 4,107,893 A * | 8/1978 | Rensch | E04B 1/24 | 52/775 |
| 4,151,682 A | 5/1979 | Schmidt | | |

(Continued)

FOREIGN PATENT DOCUMENTS

CA 2814603 A1 * 11/2014 ..... E06B 3/26301

*Primary Examiner* — Joshua J Michener
*Assistant Examiner* — Matthew Gitlin
(74) *Attorney, Agent, or Firm* — Christopher Pilling

(57) ABSTRACT

A thermal break system, comprising an inside steel panel having an inner surface and an outer surface, and a C-shaped section extending about a periphery thereof with a portion of the C-shaped section extending in part parallel to the inner surface of the inside steel panel; an outside steel panel having an inner surface and an outer surface, and a C-shaped section extending about a periphery thereof with a portion of the C-shaped section extending in part parallel to the inner surface of the outside steel panel; and an insulating material interposed between respective C-shaped sections of the inside steel panel and the outside steel panel to thermally isolate the inside steel panel and the outside steel panel from each other, and said inside steel panel and outside steel panel being secured together at respective C-shaped sections to form the thermal break system.

7 Claims, 3 Drawing Sheets

(56) References Cited

U.S. PATENT DOCUMENTS 4,183,393 A * 1/1980 Bailey ..... E06B 3/485 160/232
4,391,073 A * 7/1983 Mollenkopf ..... E04B 2/7427 52/126.4
4,524,112 A * 6/1985 Willert ..... E06B 3/273 428/595
4,594,831 A 6/1986 Winyard
4,674,248 A * 6/1987 Hall ..... E06B 5/16 49/504
4,897,971 A * 2/1990 Durston ..... E04C 2/36 428/116
4,930,257 A 6/1990 Windgassen
5,228,257 A * 7/1993 Bowersox ..... E04B 2/72 52/588.1
5,671,583 A * 9/1997 Turner ..... E04F 13/06 52/745.15
5,771,644 A * 6/1998 Kidd ..... E06B 1/6092 49/504
6,128,864 A * 10/2000 Barry ..... E06B 1/006 52/86
6,374,571 B1 * 4/2002 Mann ..... E04C 2/292 52/404.4
6,430,888 B1 * 8/2002 Dombchik ..... E04C 3/06 52/653.1
6,568,149 B2 5/2003 Lacasse
6,860,072 B2 * 3/2005 Smerud ..... E06B 1/006 52/211
6,962,025 B1 11/2005 Hill
7,562,497 B2 * 7/2009 Warren ..... E06B 1/006 52/211
7,739,850 B2 * 6/2010 Daudet ..... E04B 1/24 52/210
8,186,132 B2 * 5/2012 Howery, Jr. ..... E04B 1/08 52/262
8,516,756 B2 8/2013 Thielmann
8,555,592 B2 * 10/2013 Daudet ..... E04B 1/2403 52/489.1
8,615,942 B2 * 12/2013 Lafreniere ..... E04B 2/766 52/204.2
8,826,616 B1 9/2014 Gosselin
9,103,113 B2 * 8/2015 Lockhart ..... E04B 2/7412
2004/0194425 A1 * 10/2004 Santa Cruz ..... E04F 19/00 52/749.1
2006/0096192 A1 * 5/2006 Daudet ..... E04B 1/24 52/204.1
2006/0096201 A1 * 5/2006 Daudet ..... E04B 1/24 52/272
2010/0088977 A1 * 4/2010 Darling ..... E04F 13/04 52/86
2010/0269450 A1 10/2010 Thielmann
2011/0283625 A1 11/2011 Lenox et al.
2012/0011793 A1 1/2012 Clark et al.
2012/0227338 A1 * 9/2012 Fitzpatrick ..... E06B 1/08 52/211

* cited by examiner

THERMAL BREAK SYSTEM AND METHOD FOR DOORS AND WINDOWS

CROSS-REFERENCE TO RELATED APPLICATION

The present application claims priority to U.S. Provisional Patent Application Ser. No. 62/141,615, filed on Apr. 9, 2015, the disclosure of which is hereby incorporated in its entirety at least by reference.

FIELD OF THE INVENTION

This invention relates to steel tubes used in the construction of the frames (stiles and rails) of windows and doors that are provided with a thermal break. In particular the invention relates to a method and system of providing a thermal break in carbon steel or stainless steel tubes, with a wall thickness of between 10 and 16 gauge, used in the construction of windows and doors of any shape, including square, rectangular, round, curved or otherwise complex shapes. The invention also relates to tubes made of other thermally conductive metal, such as aluminum, although it provides especially unexpected good results with steel.

BACKGROUND OF THE INVENTION

The present invention relates to the technical field of fabrication of frames (stiles and rails) of doors and windows using hollow steel tubing, with a wall thickness of between 10 gauge and 16 gauge, where there is a requirement to control thermal conductivity between components inside and outside of a building.

The frames of conventional, thick walled, steel doors and windows are constructed from hollow tubes that may contain insulation within the hollow cavity of the tubing. This insulation controls both radiation and convection across the cavity but does not control conduction of heat through the steel walls of the tubes. Conduction of heat can cause significant energy loss and, in cold climates, doors and window frames can become very cold on the inside, causing problems of condensation and frosting. The present invention provides a means of providing a "thermal break" with an insulating material which separates inside and outside components from direct contact and effectively controls conduction.

Existing approaches teach that we may use two or more tubes separated by an insulating barrier to provide a thermal break. While such an arrangement limits conduction, the contact area is the full width of the tubing, which greatly reduces the effective insulating properties of the thermal break. Such an arrangement also uses much more steel than a conventional construction, increasing both cost and weight. Accordingly, these problems are overcome by the present invention which provides a means of adding a thermal break in thick walled tube construction that adds little weight and which utilizes the thermal properties of the insulating material to the greatest effect.

Although thermal breaks are common in the frames of aluminum windows and doors, the method and means of application requires the use of extruded profiles of aluminum that are not generally available in steel or, if available, would result in a structure far too heavy to be practicable. Some thermal breaks have been made using steel sheeting bent into complex folds that is only possible with steel thinner than 16 gauge. The present invention enables a thermal break to be provided in tubing constructed of carbon or stainless steel of between 10 gauge and 16 gauge.

The folded and extruded profiles currently used to create a thermal break can only be applied to straight sections of doors and windows and not to curved shapes such as a round window or an arched door or window. The present invention allows the thermal break to be utilized in the frames of square, rectangular, curved and or complex shaped doors and windows.

BRIEF SUMMARY

In one embodiment of the present invention, a thermal break system is provided comprising an inside steel panel having an inner surface and an outer surface, and a C-shaped section extending about a periphery thereof with a portion of the C-shaped section extending in part parallel to the inner surface of the inside steel panel; an outside steel panel having an inner surface and an outer surface, and a C-shaped section extending about a periphery thereof with a portion of the C-shaped section extending in part parallel to the inner surface of the outside steel panel; and an insulating material interposed between respective C-shaped sections of the inside steel panel and the outside steel panel to thermally isolate the inside steel panel and the outside steel panel from each other, and said inside steel panel and outside steel panel being secured together at respective C-shaped sections to form the thermal break system.

In one embodiment the inside and outside steel panel has a thickness of 10 gauge to 16 gauge. In another embodiment, the system is a window. In yet another embodiment, the system is a door. In one embodiment, the door is an arched door comprising a first upright stile, a second upright stile, and a curved rail.

In another aspect to the invention, a door is provided comprising an inside metal panel having an inner surface and an outer surface, and a C-shaped section extending about a periphery thereof with a portion of the C-shaped section extending in part parallel to the inner surface of the inside metal panel; an outside metal panel having an inner surface and an outer surface, and a C-shaped section extending about a periphery thereof with a portion of the C-shaped section extending in part parallel to the inner surface of the outside metal panel; and an insulating material interposed between respective C-shaped sections of the inside metal panel and the outside metal panel to thermally isolate the inside metal panel and the outside metal panel from each other, and said inside metal panel and outside metal panel being secured together at respective C-shaped sections to form the door. In another embodiment, the metal is aluminum.

In yet another aspect to the invention a tube assembly is provided comprising a first side having a first inner surface, a first outer surface, a first edge, and a second edge, the distance between the first edge and second edge defining a first width; a first panel located at the first edge extending perpendicularly from the first inner surface at a first depth; a second panel located at the second edge extending perpendicularly from the first inner surface at a second depth; a first land perpendicularly connected to the first panel extending parallel to the first inner surface, the first land having a first length; a second land perpendicularly connected to the second panel extending parallel to the first inner surface, the second land having a second length; a second side having a second inner surface, a second outer surface, a third edge, and a fourth edge, the distance between the third edge and fourth edge defining a second width; a third panel located at the third edge extending perpendicularly from the second inner surface at a third depth; a fourth panel located at the fourth edge extending perpendicularly from the second inner surface at a fourth depth; a third land perpendicularly connected to the third panel extending parallel to the second inner surface, the third land having a third length; a fourth land perpendicularly connected to the fourth panel extending parallel to the second inner surface, the fourth land having a fourth length; a first thermal break having a third width positioned between the first and third land; a second thermal break having a fourth width positioned between the second and fourth land; the first width and the second width being identical; the first length, third length, and third width being identical; and the second length, the fourth length, and the fourth width being identical.

In one embodiment, the first outer surface is exposed to environmental conditions and the second outer surface faces the interior of a building. In one embodiment, the first side comprising a first section, second section, and third section; and the second side comprising a fourth section, fifth selection, and sixth section; the first, third, fourth, and sixth sections consisting of upright stiles; the second and fifth section consisting of a curved rail. In another embodiment, the first and second sides joined to make an arched door. In one embodiment, the first and second sides joined to make an arched window. In yet another embodiment, a plurality of temporary access holes designed to allow access to a plurality of assembly screws is provided, the plurality of assembly screws joining the first land, third land, and first thermal break together and the second land, the fourth land, and the second thermal break together, the plurality of assembly screws being self-drilling and self-tapping. In one embodiment, the tube assembly of claim 8, further comprising adhesive means between the first land, third land, and first thermal break, and the second land, the fourth land, and the second thermal break.

BRIEF DESCRIPTION OF THE DRAWINGS

Having briefly described the invention the same, will become better understood from the appended drawings, wherein.

DESCRIPTION OF PREFERRED EMBODIMENT

The present invention provides a thermal break for the frames (stiles and rails) of square, rectangular, curved and or complex shaped doors and windows made from carbon or stainless steel of between 10 gauge and 16 gauge. A tube is constructed comprising two "C" shaped profiles of steel with two strips of a suitable insulating material sandwiched between them. A suitable insulation material may be, for example Acrylonitrile Butadiene Styrene (ABS) or Polystyrene. In order to provide sufficient mechanical strength, an adhesive bonding agent and a plurality of metal screws are used join the components where they meet.

The final assembly becomes a single hollow tube with one side effectively separated from the other so as to control the conduction of heat around the wall of the tube. This tube can be further filled with insulating foam so that radiation and convection within the tube is also controlled.

The process of manufacture is able to be applied to straight tubes, tubes of any degree of curvature and complex shapes that are combinations of straights and curves. In this manner windows and doors of any size and shape may be provided with the thermal break.

In an alternative aspect, the present invention provides a thermal break for the frames (stiles and rails) of square, rectangular, curved and or complex shaped doors and windows made from thermally conductive metal, such as aluminum. A tube is constructed comprising two "C" shaped profiles of steel with two strips of a suitable insulating material sandwiched between them. A suitable insulation material may be, for example Acrylonitrile Butadiene Styrene (ABS) or Polystyrene. In order to provide sufficient mechanical strength, an adhesive bonding agent and a plurality of metal screws are used join the components where they meet.

Figure 1:
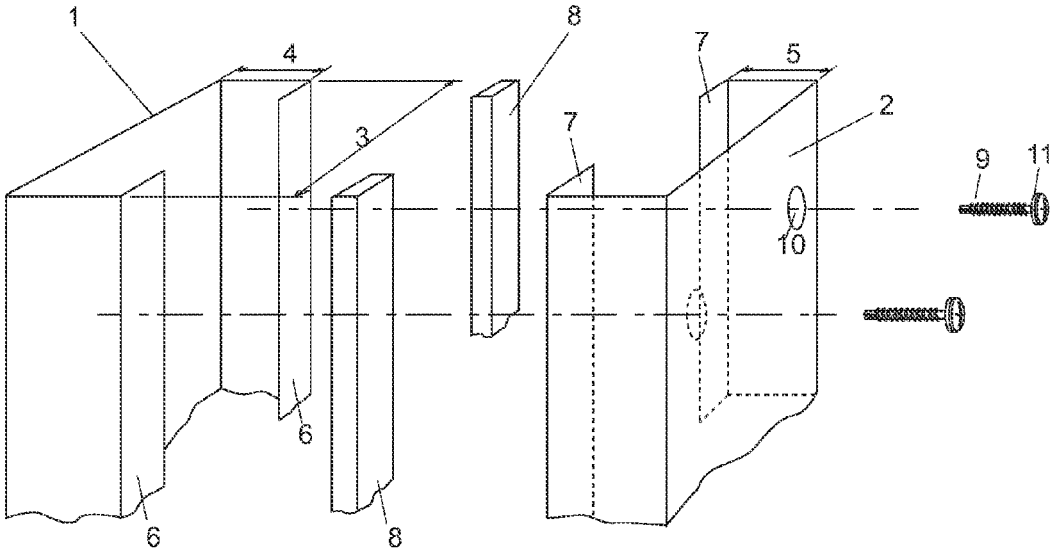
FIG. 1 is an exploded cross section view of a thermal break created in a straight tube assembly.

FIG. 1 is an exploded cross section view of a thermal break created in a straight tube assembly. Referring now to FIG. 1, a tube is constructed using two sides, 1 and 2, made in a "C" profile with a width 3 essentially identical. One tube 1 is made up of an outer surface and an inner surface of an outside steel panel, for example, making up the surface of a door facing the exterior. The outer surface thereof faces the exterior of a building. The inner surface faces the tube 2 making up the panel facing the interior of a building. With respect to tube 2, its inner surface faces the inner surface of tube 1, and its outer surface faces the interior of a building when assembled. Depth 4 and 5 of said sides may be dissimilar and does not affect the function of the invention. The sides terminate with lands 6 and 7 having a width which is less than 50% of the width 3 of profiles 1 and 2, determined by the strength requirement of the particular application. Insulating strips 8, with a width approximately the same as lands 6 and a depth sufficient to provide the degree of insulation required, are sandwiched between profiles 1 and 2, coincident with lands 6 and 7. The assembly is joined using a plurality of self-drilling, self-tapping screws 9 in combination with an adhesive means applied to adjacent faces of lands 6 and 7, and insulating strips 8. Screws 9, having an insulating washer means 11 under the screw head, pass through temporary access holes 10, whose diameter is sufficient to allow washer means 11 to easily pass. Typical adhesives useful for the invention include Liquid Nails, Bostick, Dap or Tightbond. Alternative screw arrangements may be self-tapping but not self-drilling, in which case suitable pilot holes may be pre-drilled in lands 6 and 7, as well as insulating strips 8 along an axis coincident with access holes 10.

Figure 2:
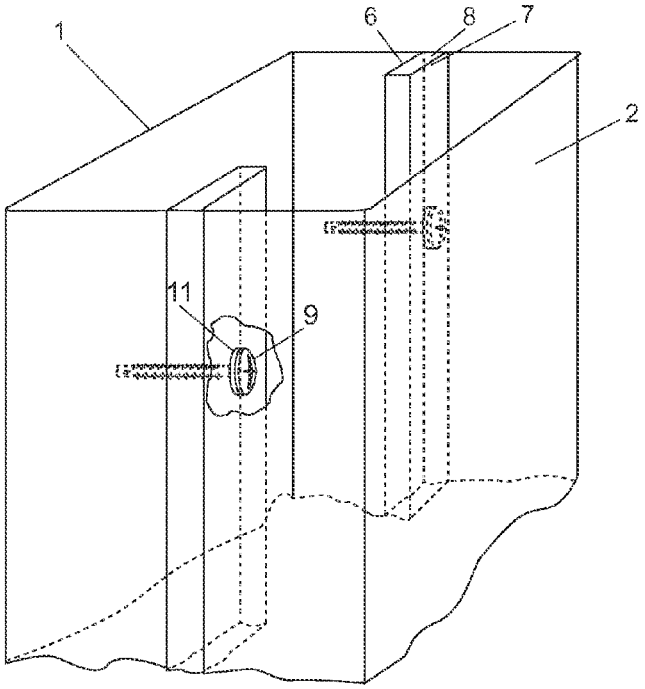
FIG. 2 is a cross-section view of a tube after construction shown with two sides connected through an insulating strip.

FIG. 2 is a cross-section view of a tube after construction shown with two sides connected through an insulating strip. FIG. 2 shows a cross section of the tube after construction where the sides 1 and 2 are connected with insulating strips 8, typically made of ABS, sandwiched between them. The adjoining faces of lands are connected using a suitable adhesive medium and/or a mechanical connection using a plurality of screws 9 with insulated washer means 11 to connect lands 6 and 7, passing through insulating strips 8. Access holes 10 are not shown since they have been closed with electric arc welding.

Figure 3:
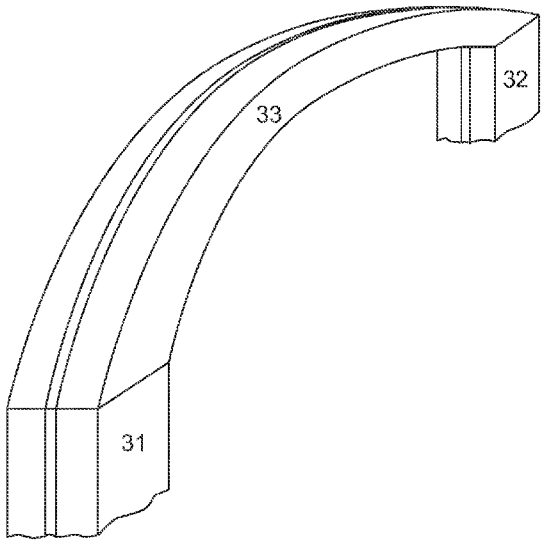
FIG. 3 is a partial top section view of an arched door constructed according to the invention.

FIG. 3 is a partial top section view of an arched door constructed according to the invention. Referring now to FIG. 3 a top section of an arched door frame is shown, which has been constructed using the same method as shown for the embodiment in FIG. 1 and FIG. 2. However, in this case the assembly comprises two upright stiles 31 and 32 and a curved rail 33. The method of construction is essentially similar to that shown in FIG. 1 and FIG. 2.

Figure 4:
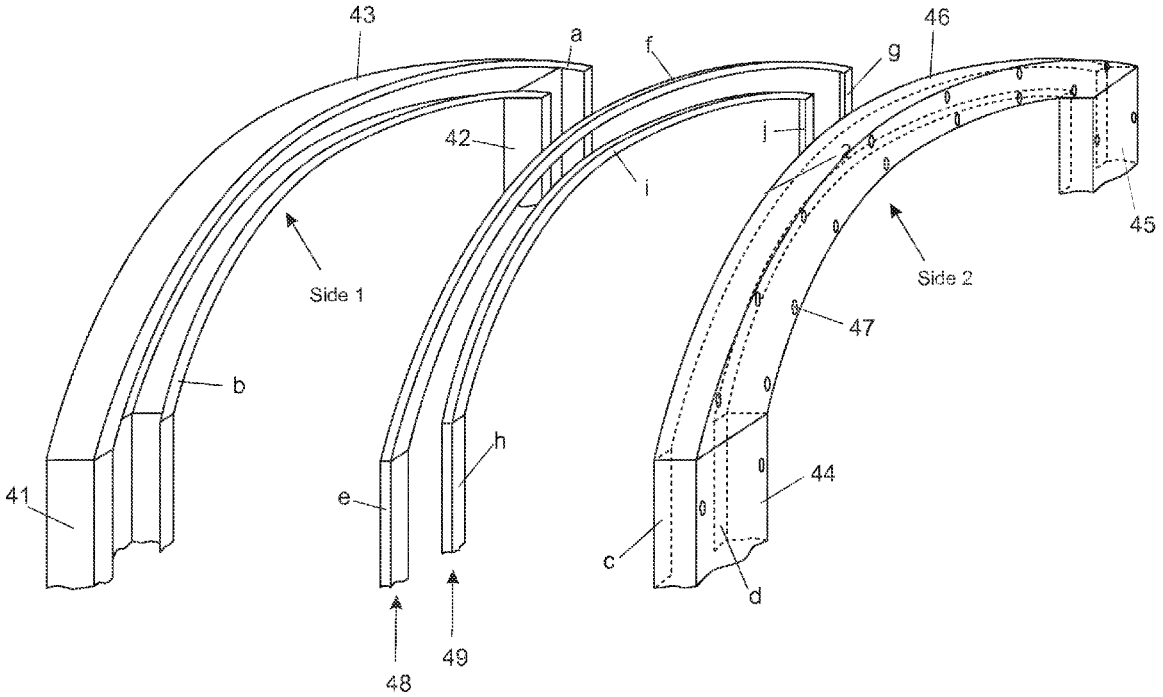
FIG. 4 is an exploded view of the door of FIG. 3 showing the components thereof.

FIG. 4 shows the components of the same section of door shown in FIG. 3 but prior to assembly. Side 1 and side 2 are each comprised of three "C" sections of steel. Side 1 comprises upright stiles 41 and 42, plus a curved rail 43. Side 2 comprises upright stiles 44 and 45, plus a curved rail 46. Upright stiles 42, 42, 44 and 45 have been made by bending sheet steel in a press break. Curved rails 43 and 46 have been fabricated out of sheet steel by cutting the curved shapes that are required in the vertical plane and cutting and bending the shapes needed in the horizontal plain. These components are then welded together to form the curved "C" sections. Specifically, upright stiles 41 and 42 are welded to curved rail 43 to form side 1 of the assembly. Similarly, curved rail 46 and upright stiles 44 and 45 are welded together to form side 2. Side 1 and 2 include lands (a), (b), (c), and (d). Insulating strips 48 and 49 comprising sections (e), (f), (g), (h), (i), and (j) are cut from sheet material to a size and shape coincident with lands (a), (b), (c), and (d) of sides 1 and 2. A plurality of temporary access holes 47 are drilled into side 2 so as to facilitate assembly with adhesive and screws the same as shown in FIGS. 1 and 2. These access holes will be welded closed after assembly.

Figure 5:
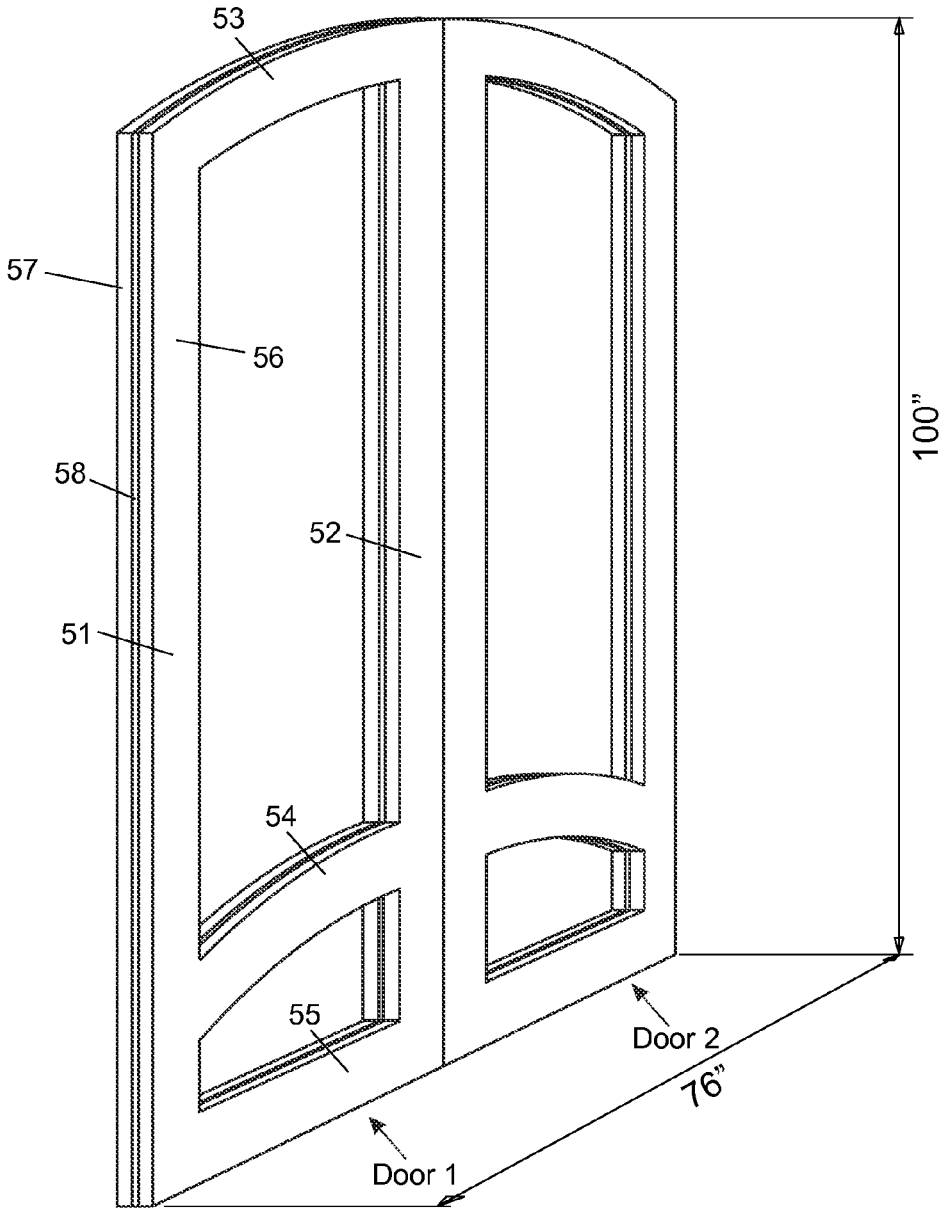
FIG. 5 is a perspective view of a pair of doors constructed according to the invention.

FIG. 5 is a perspective view of a pair of doors constructed according to the invention. Referring now to FIG. 5, a pair of typical steel door slabs constructed using the system method of the present invention is shown. Door 1 and Door 2 are essentially identical to each other but mirrored. Each one is comprised of two upright stiles 51 and 22, two curved rails 53 and 54 and one straight rail 55. Side 56 of doors is separated from side 57 by thermal break 58.

The advantages of the present invention include, without limitation, that it is highly efficient at controlling heat conduction from one side to the other. For example, door slabs of FIG. 5 being 100" high and 76" wide, a typical size for a double entry door, if constructed of 14 gauge steel would have a conductive transfer area of 117 square inches. The door slabs constructed using the present invention, utilizing 80 of 3 mm diameter screws to attach side 56 and side 57 across thermal break 58 has a conductive transfer area of 5.8 square inches or less than 5% of the conductive transfer area of the conventional door slab construction. The present invention is also light weight, using approximately 30% less steel than the prior method of sandwiching a thermal break between two tubes. The present invention also provides a tubular structure with a single cavity that can be filled with a suitable foam insulation material in order to further improve efficiency by controlling convection and radiation within the tubes. The present invention also utilizes conventional material and manufacturing equipment commonly found in metal factories, i.e., folding, drilling, welding and screwing together of steel. The present invention can be applied to produce insulated tubular doors and windows of curved and complex shapes in addition to conventional square and rectangular doors and windows.

While the invention has been described specifically as being implemented with steel, it will be appreciated that structures such as doors or windows made with other metals which are thermally conductive, such as aluminum, will benefit from the use of the invention even though perhaps not as much as in the case of steel.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A door frame assembly comprising:

a first side having a first inner surface, a first outer surface, a first edge, and a second edge, the distance between the first edge and second edge defining a first width;

a first panel located at the first edge extending perpendicularly from the first inner surface at a first depth;

a second panel located at the second edge extending perpendicularly from the first inner surface at a second depth;

a first land perpendicularly connected to the first panel extending parallel to the first inner surface, the first land having a first length;

a second land perpendicularly connected to the second panel extending parallel to the first inner surface, the second land having a second length;

a second side having a second inner surface, a second outer surface, a third edge, and a fourth edge, the distance between the third edge and fourth edge defining a second width;

a third panel located at the third edge extending perpendicularly from the second inner surface at a third depth;

a fourth panel located at the fourth edge extending perpendicularly from the second inner surface at a fourth depth;

a third land perpendicularly connected to the third panel extending parallel to the second inner surface, the third land having a third length;

a fourth land perpendicularly connected to the fourth panel extending parallel to the second inner surface, the fourth land having a fourth length;

a first thermal break having a third width positioned between the first and third land;

a second thermal break having a fourth width positioned between the second and fourth land;

the first width and the second width being identical;

the first length, third length, and third width being identical;

the second length, the fourth length, and the fourth width being identical; and a plurality of metal screws clamping the first land, the third land, and the first thermal break together and the second land, the fourth land, and the second thermal break together, the plurality of metal screws providing mechanical strength;

wherein the first side comprising a first section, second section, and third section; and the second side comprising a fourth section, fifth selection, and sixth section; the first, third, fourth, and sixth sections consisting of upright stiles; the second and fifth section consisting of a curved rail.

2. The door frame assembly of claim 1, wherein the first outer surface is exposed to environmental conditions and the second outer surface faces the interior of a building.

3. The door frame assembly of claim 1, wherein the first and second sides joined to make an arched door.

4. The door frame assembly of claim 1, further comprising a plurality of temporary access holes designed to allow access to the plurality of metal screws, the plurality of metal screws being self-tapping.

5. The door frame assembly of claim 1, further comprising adhesive means between the first land, third land, and first thermal break, and the second land, the fourth land, and the second thermal break.

6. The door frame assembly of claim 5, wherein the first and second thermal break are constructed from a non-adhesive material, wherein the non-adhesive material is acrylonitrile butadiene styrene, polystyrene, or other insulating material.

7. The door frame assembly of claim 1, wherein the door frame assembly is constructed from steel having a thickness of 10 gauge to 16 gauge, wherein the steel is carbon or stainless.

* * * * *